US010260129B2

(12) United States Patent
Baker et al.

(10) Patent No.: US 10,260,129 B2
(45) Date of Patent: Apr. 16, 2019

(54) ULTRA SUPERCRITICAL BOILER HEADER ALLOY AND METHOD OF PREPARATION

(71) Applicant: Huntington Alloys Corporation, Huntington, WV (US)

(72) Inventors: Brian A. Baker, Kitts Hill, OH (US); Gaylord D. Smith, Huntington, WV (US); Ronald D. Gollihue, Grayson, KY (US)

(73) Assignee: Huntington Alloys Corporation, Huntington, WV (US)

( * ) Notice: Subject to any disclaimer, the term of this patent is extended or adjusted under 35 U.S.C. 154(b) by 0 days.

(21) Appl. No.: 16/051,874

(22) Filed: Aug. 1, 2018

(65) Prior Publication Data

US 2018/0340242 A1 Nov. 29, 2018

Related U.S. Application Data

(63) Continuation of application No. 12/420,251, filed on Apr. 8, 2009, now Pat. No. 10,041,153.

(60) Provisional application No. 61/043,881, filed on Apr. 10, 2008.

(51) Int. Cl.

| | |
|---|---|
| ***C22C 19/05*** | (2006.01) |
| ***C22F 1/10*** | (2006.01) |
| ***F22B 37/22*** | (2006.01) |

(52) U.S. Cl.

CPC ..... *C22C 19/055* (2013.01); *C22C 19/05* (2013.01); *C22C 19/058* (2013.01); *C22F 1/10* (2013.01); *F22B 37/22* (2013.01)

(58) Field of Classification Search

None

See application file for complete search history.

(56) References Cited

U.S. PATENT DOCUMENTS 6,106,767 A * 8/2000 Kennedy ..... C22C 30/00 420/448

FOREIGN PATENT DOCUMENTS

JP H 08/188841 * 7/1996 ..... C22C 19/05

OTHER PUBLICATIONS

English translation of JPH 08/188841 (Year: 1996).*

* cited by examiner

*Primary Examiner* — Yoshitoshi Takeuchi

(74) *Attorney, Agent, or Firm* — Burris Law, PLLC

(57) ABSTRACT

A high temperature, high strength Ni—Co—Cr alloy is provided. The alloy includes, in weight percent (wt. %): 23.5 to 25.5% Cr, 15.0 to 22.0% Co, 1.1 to 2.0% Al, 1.0 to 1.8% Ti, 0.95 to 2.2% Nb, less than 1.0% Mo, less than 1.0% Mn, up to 0.24% Si, less than 3.0% Fe, less than 0.3% Ta, less than 0.3% W, 0.005 to 0.08% C, 0.01 to 0.3% Zr, 0.0008 to 0.006% B, up to 0.05% rare earth metals, and a balance of Ni plus trace impurities.

17 Claims, 3 Drawing Sheets

ULTRA SUPERCRITICAL BOILER HEADER ALLOY AND METHOD OF PREPARATION

CROSS-REFERENCE TO RELATED APPLICATIONS

Figure 1:
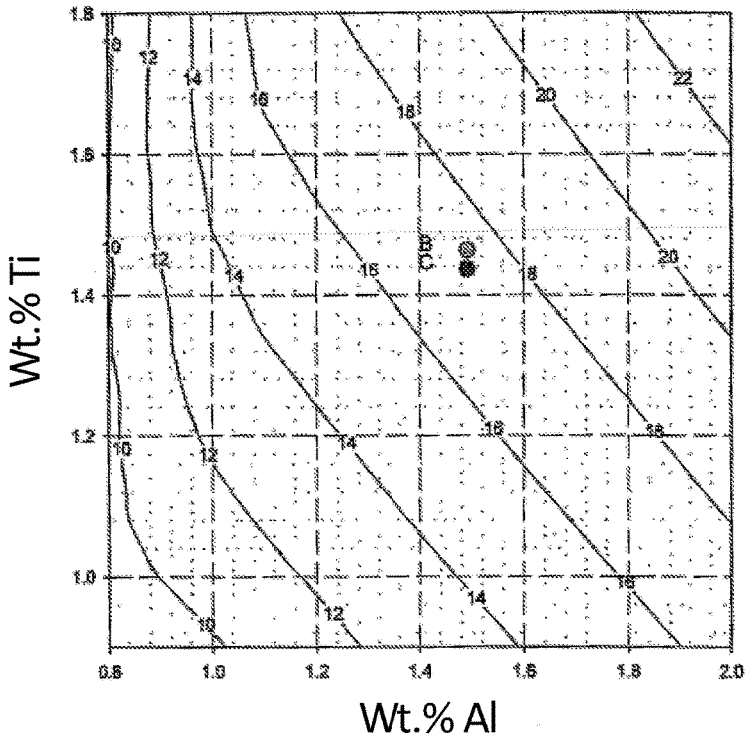

This application is a continuation application of U.S. patent application Ser. No. 12/420,251 filed on Apr. 8, 2009, which claims the benefit of U.S. Provisional Patent Application No. 61/043,881 filed Apr. 10, 2008, both of which are incorporated herein by reference.

FIELD

The present disclosure relates to an alloy suitable for a header pipe in boiler applications and, more particularly, to a high temperature, high strength nickel (Ni)-cobalt (Co)-chromium (Cr) alloy for long-life service at 538° C. to 816° C. that offers a combination of strength, ductility, stability, toughness and fissure-free weldability as to render the alloy range uniquely suitable for the header pipe in ultra-supercritical boiler applications where essentially fissure-free joining of boiler tubes to the header is critical.

BACKGROUND

Over the years, metallurgists engaged in material development for the utility industry have continually developed alloys meeting requirements for both high strength at elevated temperatures and corrosion resistance under severe environmental conditions. This quest for increasing performance is far from over as designers and engineers seek to increase productivity and efficiency, lower operating costs and extend service lives. All too often, researchers terminated their efforts when the target combination of properties was achieved, thereby leaving the optimization of the alloy range open for future exploitation. Such is the case, for example, in coal-fired, ultra-supercritical boiler materials in critical need of advanced alloys to maintain progress. This service requires ever-increasing strength at increasingly higher temperatures, as operating conditions become more demanding and service lives are required to be trouble-free over the life of the equipment. Coal-fired ultra-supercritical boiler designers must develop the materials meeting their advanced requirements as they improve efficiency by raising steam pressure and temperature.

Today's boilers with efficiencies around 45% typically operate up to 290 bar steam pressure and 580° C. steam temperature. Designers are setting their sights on 50% efficiency or better by raising the steam conditions as high as 325 bar/760° C. To meet this requirement in the boiler materials, the 100,000 hour stress rupture life must exceed 100 MPa at temperatures as high as 760° C. Additionally, raising steam temperature has made steam corrosion more troublesome placing a further requirement on any new alloy. This requirement is less than 2 mm of metal loss in 200,000 hours for steam oxidation in the temperature range of 700° C. to 800° C. For service as a header alloy, the material must be fabricable as thick-walled pipe (i.e., up to 80 mm wall thickness) and be fissure-free weldable into complex headers using conventional metal working and welding equipment. This places a major constraint on the fabricability and welding characteristics acceptable in manufacture and field installation. Such characteristics run counter to the need for superior strength in boiler tube service.

To meet the strength and temperature requirements of future ultra-supercritical boiler materials, designers must exclude the usual ferritic, solid solution austenitic and age-hardenable alloys heretofore employed for this service. These materials commonly lack one or more of the requirements of adequate strength, temperature capability and stability or steam corrosion resistance. For example, the typical age-hardenable alloy must be alloyed with insufficient chromium for oxidation resistance in order to maximize the age-hardening potential of the alloy, thereby developing high strength at elevated temperatures. However, adding chromium not only degrades the strengthening mechanism but, if added in excess, can result in embrittling sigma or alpha-chromium formation. Since 538° C. to 816° C. is a very active range for carbide precipitation and embrittling grain boundary film formation, alloy stability is compromised in many alloys in the interest of achieving high temperature strength and adequate steam oxidation resistance.

SUMMARY

In one form of the present disclosure, a high temperature, high strength Ni—Co—Cr alloy comprising, in weight percent (wt. %), 23.5 to 25.5% Cr, 15.0 to 22.0% Co, 1.1 to 2.0% Al, 1.0 to 1.8% Ti, 0.95 to 2.2% Nb, less than 1.0% Mo, less than 1.0% Mn, up to 0.24% Si, less than 3.0% Fe, less than 0.3% Ta, less than 0.3% W, 0.005 to 0.08% C, 0.01 to 0.3% Zr, 0.0008 to 0.006% B, up to 0.05% rare earth metals, and a balance of Ni plus trace impurities is provided.

In an alloy of the present disclosure, the alloy comprises at least one of the following: Cr content is 24.0 to 25.3%; Co content is 18.0 to 21.0%; Al content is 1.2 to 1.8%; Ti content is 1.1 to 1.6%; Nb content is 1.0 to 2.1%; Mo content is 0.08 to 0.8%; Mn content is 0.1 to 0.8%; Fe content is 0.25 to 2.8%; Ta content is 0.05 to less than 0.3%; and W content is 0.05 to less than 0.3%.

In numerous alloys of the present disclosure, the alloy comprises one of the following: Cr content is 24.2 to 25.2%; Co content is 19.0 to 20.5%; Al content is 1.2 to 1.6%; Ti content is 1.1 to 1.5; Nb content is 1.0 to 2.0%; Mo content is 0.2 to 0.6%; Mn content is 0.2 to 0.6%; Fe content is 0.5 to 2.5%; Ta content is 0.1 to 0.3%; and W content is 0.1 to less than 0.3%.

At least one of the alloys of the present disclosure possesses essentially fissure-free weldability.

In another form of the present disclosure, a high temperature, high strength Ni—Co—Cr alloy comprising, in weight %, 24.0 to 25.3% Cr, 18.0 to 21.0% Co, 1.2 to 1.8% Al, 1.1 to 1.6% Ti, 1.0 to 2.1% Nb, 0.08 to 0.8% Mo, 0.1 to 0.8% Mn, up to 0.24% Si, 0.25 to 2.8% Fe, 0.05 to less than 0.3% Ta, 0.05 to less than 0.3% W, 0.01 to 0.06% C, 0.05 to 0.25% Zr, 0.001 to 0.004% B, 0.001 to 0.04% rare earth metals, and a balance of Ni plus trace impurities is provided.

In other alloys of the present disclosure: the Cr content is 24.2 to 25.2%, the Co content is 19.0 to 20.5%, and the Al content is 1.2 to 1.6%; the Ti content is 1.1 to 1.5, the Nb content is 1.0 to 2.0%, and the Mo content is 0.2 to 0.6%; and the Mn content is 0.2 to 0.6%, the Fe content is 0.5 to 2.5%, the Ta content is 0.1 to 0.3%, and the W content is 0.1 to less than 0.3%;

In yet another form of the present disclosure, a high temperature, high strength Ni—Co—Cr alloy comprising, in weight %, 24.2 to 25.2% Cr, 19.0 to 20.5% Co, 1.2 to 1.6% Al, 1.1 to 1.5% Ti, 1.0 to 2.0% Nb, 0.2 to 0.6% Mo, 0.2 to 0.6% Mn, up to 0.24% Si, 0.5 to 2.5% Fe, 0.1 to less than 0.3% Ta, 0.1 to less than 0.3% W, 0.02 to 0.05% C, 0.05 to 0.2% Zr, 0.001 to 0.003% B, 0.001 to 0.03% rare earth metal, and a balance of Ni plus trace impurities is provided.

A better appreciation of the alloying difficulties is presented by defining below the benefits and impediments associated with each element employed in this disclosure.

DRAWINGS

Figure 2:
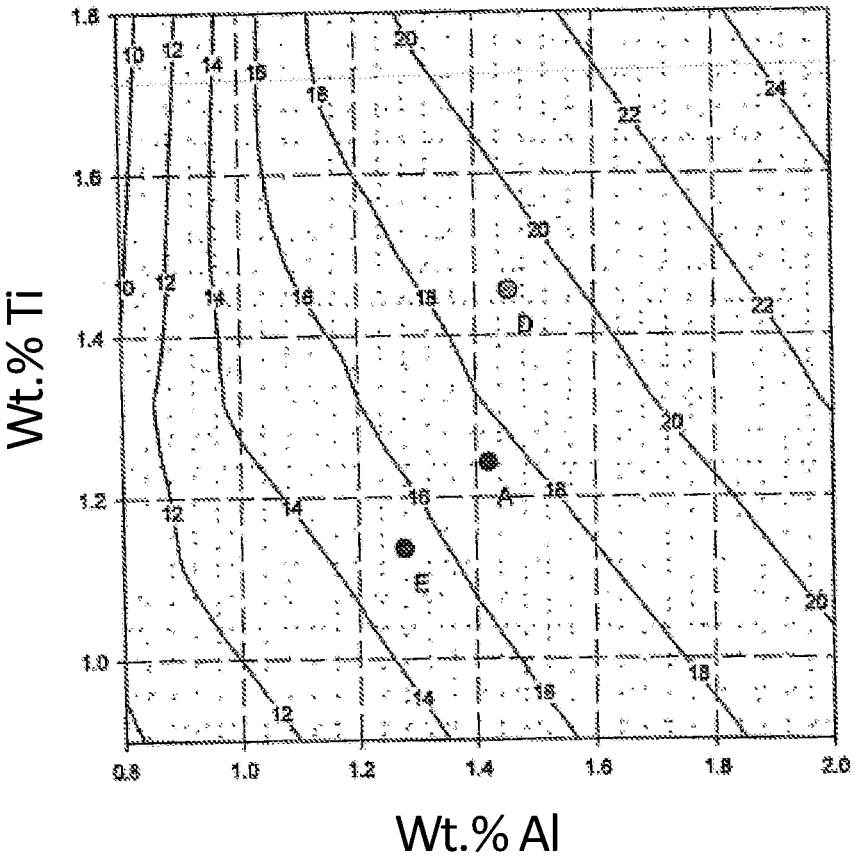
Figure 3:
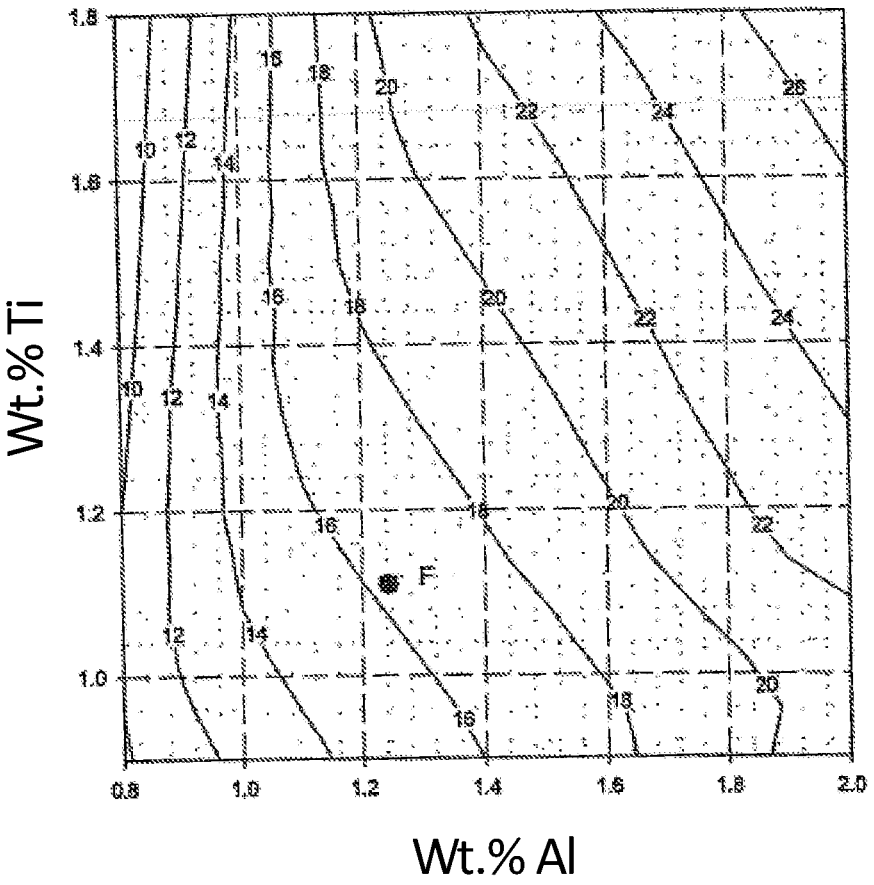

FIG. 1 is an isopleth showing gamma prime weight percentage as a function of aluminum and titanium in a material comprising 24.5 wt. % Cr, 20 wt. % Co, 1 wt. % Nb, 1 wt. % Fe, 0.03 wt. % C and the balance Ni at 760° C. in accordance with the present disclosure;

FIG. 2 is an isopleth showing gamma prime weight percentage as a function of aluminum and titanium in a material comprising 24.5 wt. % Cr, 20 wt. % Co, 1.5 wt. % Nb, 1 wt. % Fe, 0.03 wt. % C and the balance Ni at 760° C. in accordance with the present disclosure; and FIG. 3 is an isopleth showing gamma prime weight percentage as a function of aluminum and titanium in a material comprising 24.5 wt. % Cr, 20 wt. % Co, 2 wt. % Nb, 1 wt. % Fe, 0.03 wt. % C and the balance Ni at 760° C. in accordance with the present disclosure.

DETAILED DESCRIPTION

The chemical compositions set forth throughout this specification are in weight percentages unless otherwise specified. In accordance with the present disclosure, the alloy broadly contains 23.5 to 25.5% Cr, 15-22% Co, 1.1 to 2.0% Al, 1.0 to 1.8% Ti, 0.95 to 2.2% Nb, less than 1.0% Mo, less than 1.0% Mn, less than 0.3% Si, less than 3% Fe, less than 0.3% Ta, less than 0.3% W, 0.005 to 0.08% C, 0.01 to 0.3% Zr, 0.0008 to 0.006% B, up to 0.05% rare earth metals, 0.005% to 0.025% Mg plus optional Ca, balance Ni including trace additions and impurities. The strength and stability are assured at 760° C. when the Al/Ti ratio is constrained to between 0.95% and 1.25%. Further, the sum of Al+Ti is constrained to between 2.25% and 3.0%. The upper limits for Nb and Si are defined by the relationship: (% Nb+0.95)+3.32(% Si)<3.16.

The above combination of elements possesses all the critical attributes required of the header in an ultra-supercritical boiler. Steam oxidation resistance can be achieved by alloying with a narrow range of Cr (23.5-25.5%) without destroying phase stability resulting from embrittling phases by concurrently limiting certain elements to very narrow ranges (e.g., less than 1% Mo, less than 0.08% C, less than 3.0% Fe, less than 0.3% Si and the total Ta plus W content less than 0.6%). Less than 23.5% Cr results in inadequate steam oxidation resistance and greater than 25.5% Cr produces embrittling phases even with the alloy restrictions defined above. Too often, striving for maximum corrosion resistance results in alloys lacking the required high temperature strength. This has been solved in the alloy of the present disclosure by balancing the weight percent of precipitation hardening elements to a narrow range where the resulting volume percent of hardening phase is between about 14 and 20% within the Ni—Co—Cr matrix. The strength and stability are assured at 760° C. when the Al/Ti ratio is constrained to between 0.95% and 1.25%. Further, the sum of Al+Ti is constrained to between 2.25% and 3.0%. Excessive amounts of the hardener elements not only reduce phase stability, lower ductility and toughness but also render pipe manufacturability extremely difficult if not impossible. The selection of each elemental alloying range can be rationalized in terms of the function each element is expected to perform within the compositional range of this patent application. This rationale is defined below.

Chromium (Cr) is an essential element in the alloy range of the present disclosure because it assures development of a protective scale which confers the high temperature steam oxidation resistance vital for the intended application. In conjunction with the minor elements Zr (up to 0.3%), Mg (up to 0.025%) and Si (up to 0.3%), the protective nature of the scale is even more enhanced and made effective to higher temperatures. The function of these minor elements is to enhance scale adhesion, density and resistance to decomposition. The minimum level of Cr is chosen to assure adequate α-chromia formation at 538° and above. This level of Cr was found to be about 23.5%. Slightly higher Cr levels accelerated α-chromia formation but did not change the nature of the scale. The maximum Cr level for this alloy range was determined by alloy phase stability and workability. This maximum level of Cr was found to be about 25.5%.

Cobalt (Co) is an essential matrix-forming element because it contributes to hot hardness and strength retention at the upper regions of the intended service temperature (538° C.-816° C.) and contributes in a significant way to the high temperature corrosion resistance of the alloy range. However, because of cost, it is preferred to maintain the level of Co below 40% of that of the Ni content Thus the beneficial range of the Co content becomes 15.0 to 22.0%.

Aluminum (Al) is an essential element in the alloy range of the present disclosure because it not only contributes to deoxidation but also reacts with Ni in conjunction with Ti and Nb to form the high temperature phase, gamma prime ($Ni_3Al$, Ti, Nb). The Al content is restricted to the range of 1.1 to 2.0%. The minimum total of Al plus Ti contributing to at least 14% hardener phase is shown in FIGS. 1 through 3 for 1% Nb, 1.5% Nb and 2.0% Nb, respectively at a service temperature of 760° C. 14% hardener phase is considered the minimum required for strength at 760° C. The compositions in accordance with the present disclosure (i.e., alloys A through F) are depicted on FIGS. 1 through 3 in association with the closest Nb content. The strength and stability is assured at 760° C. when the Al/Ti ratio is constrained to between 0.95 and 1.25. Further the sum of Al+Ti is constrained to between 2.25 and 3.0. Larger amounts than 2.0% Al in conjunction with the other hardener elements markedly reduces ductility, stability and toughness and reduces workability of the alloy range. Internal oxidation can increase with higher amounts of Al.

Titanium (Ti) in the alloy range 1.0-1.8% is an essential strengthening element as stated above and shown in FIGS. 1 through 3. Strength and stability is assured at 760° C. when the Al/Ti ratio is constrained to between 0.95 and 1.25. Further the sum of Al+Ti is constrained to between 2.25 and 3.0. Titanium also serves to act as grain size stabilizer in conjunction with Nb by forming a small amount of primary carbide of the (Ti, Nb)C type. The amount of carbide is limited to less than 1.0 volume percent in order to preserve hot and cold workability of the alloy. Titanium in amounts in excess of 1.8% can be prone to internal oxidation leading to reduced matrix ductility and lead to formation of undesirable eta phase formation.

Niobium (Nb) in the alloy within a range of 0.95-2.2% is also an essential strengthening and grain size control element. The Nb content must allow for at least 14% gamma phase formation at 760° C. when Al and Ti are present. Lowering the Nb below 0.95% increases the mismatch between gamma prime and the matrix and accelerates the gamma prime growth rate. Conversely, Nb above 2.2% increases the propensity for unwanted eta phase formation and increases the fissuring tendency. Niobium along with titanium can react with carbon to form primary carbides which act as grain size stabilizers during hot working. An excessive amount of Nb can reduce the protective nature of protective scale and hence is to be avoided. It is a further discovery that fissure-free welded joints can only be achieved when the Nb and Si are critically controlled within limits. Nb and Si are inversely related in this regard. Higher Nb levels require lower Si levels and vice-versa. In general, the following formula defines an upper limit for Nb in relation to that of Si content:

$$(\%\ Nb+0.96)+3.32(\%\ Si)<3.16 \quad (1)$$

Tantalum (Ta) and Tungsten (W) also form primary carbides which can function similarly to that of Nb and Ti. However, their negative effect on TCP phase stability limits the presence of each to less than 0.3%.

Molybdenum (Mb) can contribute to solid solution strengthening of the matrix but must be considered an element to be restricted to less than 1.0% due to its apparent deleterious effect on steam oxidation resistance and TCP phase formation when added to a greater extent to the alloys of the present disclosure.

Manganese (Mn), while an effective desulfurizer during melting, is overall a detrimental element in that it reduces protective scale integrity. Consequently, this element is maintained below 1.0%. Manganese, above this level, degrades the α-chromia by diffusing into the scale and forming the spinel, $MnCr_2O_4$. This oxide is significantly less protective of the matrix than is α-chromia.

Silicon (Si) is an acceptable element in the alloy range of the present disclosure because it can form an enhancing silica ($SiO_2$) layer beneath the α-chromia scale to further improve corrosion resistance. This is achieved by the blocking action that the silica layer contributes to inhibiting ingress of the steam molecules or ions within the header and the egress of cations of the alloy. Excessive amounts of Si can contribute to loss of ductility, toughness and workability. Si because it widens the liquidus to solidus range of the compositional range of the alloy of the present disclosure and contributes in a significant way to the formation of fissuring during welding, hence its content must be severely limited to 0.3% for optimum results. Si acts in conjunction with Nb in this regard as defined in equation (1) above. The maximum in fissure-free weldability is best achieved provided the Si level is less than 0.05%. However, the use of alloy scrap and typical commercial feed stocks suggests that a range of 0.05 to 0.3% Si is satisfactory for essentially fissure-free weldability.

Iron (Fe) additions to the alloys of the present disclosure lower the high temperature corrosion resistance by reducing the integrity of the α-chromia by forming the spinel, $FeCr_2O_4$. Consequently, it is preferred that the level of Fe be maintained at less than 3.0%. Fe can also contribute to formation of undesirable TCP phases such as sigma phase. Where virgin metal feed stock is specified in the charge make-up, a maximum limit of 0.4% Fe is desirable for best steam oxidation resistance. However, the use of alloy scrap and typical commercial feed stocks suggests that a range of 0.25 to 3.0% Fe is satisfactory for both steam oxidation resistance and essentially fissure-free weldability.

Zirconium (Zr) in amounts between 0.01 to 0.3% is effective in contributing to high temperature strength and stress rupture ductility. Larger amounts lead to grain boundary liquation and markedly reduced hot workability. Zirconium in the above compositional range also aids scale adhesion under thermally cyclic conditions.

Carbon (C) should be maintained between 0.005-0.08% to aid grain size control in conjunction with Ti and Nb since the carbides of these elements are stable in the hot working range (1000° C.-1175° C.) of the alloys of the present disclosure. These carbides also contribute to strengthening the grain boundaries to enhance stress rupture properties.

Boron (B) in amounts between 0.0008 to 0.006% is effective in contributing to high temperature strength and stress rupture ductility. Base plates of alloys I and J in Table III, set forth hereinafter, demonstrate this point showing that boron in alloy I (0.009% B) that is outside the limits of this patent application is subject to gross fissuring (counts as high as 21 fissures vs. 1 or 2 for alloy J (0.004% B)). Alloy I failed a 2T bend whereas alloy J did not. Alloys I and J were manual Gas Tungsten Arc Welded (GTAW) with filler metal of composition K in Table III.

Magnesium (Mg) and optionally calcium (Ca) in total amount between 0.005 and 0.025% are both an effective desulfurizer of the alloy and a contributor to scale adhesion. Excessive amounts of these elements reduce hot workability and lower product yield. Trace amounts of lanthanum (La), yttrium (Y) or Misch metal may be present in the alloys of the present disclosure as impurities or deliberate additions up to 0.05% to promote hot workability and scale adhesion. However, their presence is not mandatory as is that of Mg and optionally Ca.

Nickel (Ni) forms the critical matrix and must be present in an amount greater than 45% in order to assure phase stability, adequate high temperature strength, ductility, toughness and good workability and weldability.

Table I, below, provides presently preferred ranges of elements that make up the alloy of the disclosure along with a presently preferred nominal composition.

TABLE I

Designation of the Compositional Ranges for the Broad, Intermediate and Narrow Limits for Ultra Supercritical Boiler Header Pipe of the Present Disclosure

| Element | Broad Weight % | Intermediate Weight % | Narrow Weight % |
|---|---|---|---|
| Cr | 23.5-25.5 | 24.0-25.3 | 24.2-25.2 |
| Co | 15.0-22.0 | 18.0-21 | 19-20.5 |
| Al | 1.1-2.0 | 1.2-1.8 | 1.2-1.6 |
| Ti | 1.0-1.8 | 1.1-1.6 | 1.1-1.5 |
| Nb | 0.95-2.2 | 1.0-2.1 | 1.0-2.0 |
| Mo | 0-1.0 | 0.08-0.8 | 0.2-0.6 |
| Mn | 0-1.0 | 0.1-0.8 | 0.2-0.6 |
| Si | 0-0.3 | 0.05-0.3 | 0.1-0.3 |
| Fe | 0-3.0 | 0.25-2.8 | 0.5-2.5 |
| Ta | 0-0.3 | 0.05-0.3 | 0.1-0.3 |
| W | 0-0.3 | 0.05-0.3 | 0.1-0.3 |
| C | 0.005-0.08 | 0.01-0.06 | 0.02-0.05 |
| Zr | 0.01-0.3 | 0.05-0.25 | 0.05-0.2 |
| B | 0.0008-0.006 | 0.001-0.004 | 0.001-0.003 |
| Rare Earth | 0-0.05 | 0.001-0.04 | 0.001-0.03 |
| Mg | 0.005-0.025 | 0.005-0.02 | 0.005-0.015 |
| Ni | 45.0-58.0 | 45.0-56.0 | 45.0-55.0 |
| Al/Ti | 0.95-1.25 | 1.0-1.20 | 1.0-1.15 |
| Al + Ti | 2.25-3.0 | 2.30-2.90 | 2.40-2.80 |
| Nb + Si | <3.16 | <3.0 | <2.8 |

EXAMPLES

Examples are set forth below. Examples of compositions within the alloy range of this patent range are presented in Table II and current commercial and experimental alloys vying for consideration in boiler fabrication are listed in Table III.

TABLE II

Compositions of the Alloys in Accordance with the Present Disclosure

| Heat | Ni | Co | Cr | Al | Ti | Nb | Mo | Si | Fe | Mn | Zr | B | C | Al/Ti | Al + Ti |
|---|---|---|---|---|---|---|---|---|---|---|---|---|---|---|---|
| A | 50.31 | 19.23 | 24.33 | 1.41 | 1.23 | 1.78 | 0.18 | 0.17 | 1.01 | 0.11 | 0.004 | 0.003 | 0.03 | 1.15 | 2.64 |
| B | 49.44 | 19.91 | 24.48 | 1.48 | 1.44 | 1.00 | 0.54 | 0.21 | 1.09 | 0.30 | 0.012 | 0.001 | 0.05 | 1.03 | 2.92 |
| C | 48.89 | 20.75 | 24.25 | 1.44 | 1.42 | 1.05 | 0.53 | 0.22 | 1.05 | 0.30 | 0.010 | 0.003 | 0.03 | 1.01 | 2.86 |
| D | 49.10 | 20.00 | 24.46 | 1.46 | 1.43 | 1.31 | 0.54 | 0.24 | 1.04 | 0.30 | 0.010 | 0.003 | 0.04 | 1.02 | 2.89 |
| E | 49.11 | 20.05 | 24.60 | 1.28 | 1.15 | 1.56 | 0.54 | 0.22 | 1.07 | 0.30 | 0.010 | 0.003 | 0.05 | 1.11 | 2.43 |
| F | 48.48 | 20.19 | 25.49 | 1.22 | 1.11 | 2.06 | 0.08 | 0.13 | 0.75 | 0.30 | 0.003 | 0.001 | 0.04 | 1.10 | 2.33 |

TABLE III

Compositions of Alloys Outside the Range of the Present Disclosure

| Heat | Ni | Co | Cr | Al | Ti | Nb | Mo | Si | Fe | Mn | Zr | B | C | Al/Ti | Al + Ti |
|---|---|---|---|---|---|---|---|---|---|---|---|---|---|---|---|
| G | 49.33 | 19.8 | 24.34 | 0.97 | 1.78 | 1.99 | 0.5 | 0.51 | 0.46 | 0.26 | 0.025 | 0.004 | 0.03 | 0.54 | 2.75 |
| H | 48.84 | 19.93 | 23.90 | 1.09 | 1.75 | 1.92 | 0.51 | 0.53 | 1.06 | 0.28 | 0.12 | 0.002 | 0.04 | 0.62 | 2.84 |
| I | 49.12 | 19.81 | 24.51 | 1.39 | 1.28 | 1.42 | 0.54 | 0.39 | 1.07 | 0.31 | 0.009 | 0.009 | 0.02 | 1.09 | 2.67 |
| J | 49.00 | 19.96 | 24.53 | 1.36 | 1.28 | 1.43 | 0.55 | 0.38 | 1.07 | 0.29 | 0.007 | 0.004 | 0.03 | 1.06 | 2.64 |
| K* | 49.70 | 20.00 | 24.14 | 0.63 | 2.10 | — | 5.80 | 0.5 m | 0.7 m | 0.6 m | — | 0.005 | 0.06 | 0.3 | 2.73 |

*K is a commercial filler metal of NIMONIC alloy 263, m = maximum

Alloy Preparation and Mechanical Testing

Alloys A through F in Table III and alloys H, I and J in Table III were vacuum induction melted as 25 kg ingots. Alloy G in Table III was 150 kg vacuum induction melted and vacuum arc remelted. Alloy K is filler metal from a commercial heat of NIMONIC alloy 263. The ingots were homogenized at 1204° C. for 16 hours and subsequently hot worked to 15 mm bar at 1177° C. with reheats as required to maintain the bar temperature at least at 1050° C. The final anneal was for times up to two hours at 1150° C. and water quenched. Standard tensile and stress rupture specimens were machined from both annealed and annealed plus aged bar (aged at 800° C. for 8 hours and air cooled). Annealed and aged room temperature tensile strength plus high temperature tensile properties are presented in Table IV below.

TABLE IV

Tensile Properties of Alloy B As-Annealed (1121° C./60 Minutes/Water Quenched) and As-Annealed Plus Aged (800° C./4 Hours/Air Cooled)

| Temperature (° C.) | Yield Strength (MPa) | Ultimate Tensile Strength (MPa) | Elongation (%) | Reduction of Area (%) |
|---|---|---|---|---|
| As-Annealed Plus Aged (800° C./4 Hours/Air Cooled) | | | | |
| 74 | 743 | 1151 | 34.4 | 37.5 |
| 750 | 618 | 743 | 6.8 | 9.3 |

Establishing the Welding Characteristics of the Alloys of the Present Disclosure Boiler header pipe, located outside the combustion section of a coal-fired ultra-supercritical boiler, performs the function of concentrating steam from all the boiler tubes and sending the steam through transfer piping to the turbine. It is usually a 5.0 to 8.0 cm thick extruded pipe (20-36 cm outer diameter) and is unique in the large number of welded tubes joined to the header pipe. The strength requirements are discussed hereinabove. The header pipe welded joints must meet pressure code requirements (ASME Section IX). The fact that the welded joints of this alloy range can be satisfactorily made is demonstrated below. Manual pulsed gas metal arc welding (manual p-GMAW) was used to demonstrate defect-free weldability. The welding parameters for manual p-GMAW are given in Table V below.

TABLE V

Manual Pulsed GMAW Parameters used in the Present Disclosure

| Parameters | Value |
|---|---|
| Amperage | 130 +/− 5 |
| Voltage | 27.0 +/− 0.75 |
| Shielding Gas | 75/25 Argon/Helium @35 cfh |
| Wire Speed | ~250 IPM/0.045" wire |
| Travel Speed | ~10.0 IPM |

1.6 cm sections of alloys B through E were welded using manual p-GMAW employing alloy G from Table III as the filler metal and the welding parameters of Table V. Prior to welding the alloys were aged and then re-aged after welding. The welded joints were metallographically examined using up to five views. The base metals of these joints were deemed essentially defect free and meeting the qualifications of ASME Section IX. The manual p-GMAW is a high heat input, rapid deposition welding technique. These results are deemed extremely significant.

While specific embodiments of the disclosure have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the disclosure which is to be given the full breadth of the appended claims and any and all equivalents thereof.

What is claimed is:

1. A Ni—Co—Cr alloy, the alloy comprising in weight %: 23.5 to 25.5% Cr, 15.0 to 22.0% Co, 1.1 to 2.0% Al, 1.0 to 1.8% Ti, 0.95 to 2.2% Nb, 0.08 to 0.8% Mo, less than 1.0% Mn, 0.05 up to 0.24% Si, less than 3.0% Fe, less than 0.3% Ta, less than 0.3% W, 0.005 to 0.08% C, 0.01 to 0.3% Zr, 0.0008 to 0.006% B, up to 0.05% rare earth metals, balance Ni plus trace impurities.

2. The alloy of claim 1, wherein the alloy comprises at least one of the following:

Cr content is 24.0 to 25.3%;

Co content is 18.0 to 21.0%;

Al content is 1.2 to 1.8%;

Ti content is 1.1 to 1.6%;

Nb content is 1.0 to 2.1%;

Mo content is 0.08 to 0.8%;

Mn content is 0.1 to 0.8%;

Fe content is 0.25 to 2.8%;

Ta content is 0.05 to less than 0.3%; and

W content is 0.05 to less than 0.3%.

3. The alloy of claim 1, wherein the Cr content is 24.2 to 25.2%.

4. The alloy of claim 1, wherein the Co content is 19.0 to 20.5%.

5. The alloy of claim 1, wherein the Al content is 1.2 to 1.6%.

6. The alloy of claim 1, wherein the Ti content is 1.1 to 1.5.

7. The alloy of claim 1, wherein the Nb content is 1.0 to 2.0%.

8. The alloy of claim 1, wherein the Mo content is 0.2 to 0.6%.

9. The alloy of claim 1, wherein the Mn content is 0.2 to 0.6%.

10. The alloy of claim 1, wherein the Fe content is 0.5 to 2.5%.

11. The alloy of claim 1, wherein the Ta content is 0.1 to less than 0.3%.

12. The alloy of claim 1, wherein the W content is 0.05 to less than 0.3%.

13. A Ni—Co—Cr alloy, the alloy comprising in weight %: 24.0 to 25.3% Cr, 18.0 to 21.0% Co, 1.2 to 1.8% Al, 1.1 to 1.6% Ti, 1.0 to 2.1% Nb, 0.08 to 0.8% Mo, 0.1 to 0.8% Mn, up to 0.24% Si, 0.25 to 2.8% Fe, 0.05 to less than 0.3% Ta, 0.05 to less than 0.3% W, 0.01 to 0.06% C, 0.05 to 0.25% Zr, 0.001 to 0.004% B, 0.001 to 0.04% rare earth metals, balance Ni plus trace impurities.

14. The alloy of claim 13, wherein the Cr content is 24.2 to 25.2%, the Co content is 19.0 to 20.5%, and the Al content is 1.2 to 1.6%.

15. The alloy of claim 13, wherein the Ti content is 1.1 to 1.5, the Nb content is 1.0 to 2.0%, and the Mo content is 0.2 to 0.6%.

16. The alloy of claim 13, wherein the Mn content is 0.2 to 0.6%, the Fe content is 0.5 to 2.5%, the Ta content is 0.1 to 0.3%, and the W content is 0.1 to less than 0.3%.

17. A Ni—Co—Cr alloy, the alloy comprising in weight %: 24.2 to 25.2% Cr, 19.0 to 20.5% Co, 1.2 to 1.6% Al, 1.1 to 1.5% Ti, 1.0 to 2.0% Nb, 0.2 to 0.6% Mo, 0.2 to 0.6% Mn, up to 0.24% Si, 0.5 to 2.5% Fe, 0.1 to less than 0.3% Ta, 0.1 to less than 0.3% W, 0.02 to 0.05% C, 0.05 to 0.2% Zr, 0.001 to 0.003% B, 0.001 to 0.03% rare earth metals, balance Ni plus trace impurities.

* * * * *